United States Patent [19]

Albrecht

[11] 3,941,065

[45] Mar. 2, 1976

[54] FLUIDIZED BED FURNACE FOR BURNING PARTLY DEHYDRATED SLUDGE AND METHOD OF BURNING SLUDGE IN A FLUIDIZED BED FURNACE

[75] Inventor: Erhard Albrecht, Essen, Germany

[73] Assignee: Rheinstahl AG, Germany

[22] Filed: Nov. 1, 1974

[21] Appl. No.: 520,208

[30] Foreign Application Priority Data

Nov. 9, 1973 Germany ..... 2356058

[52] U.S. Cl. ..... 110/8 F; 110/28 J; 110/8 A

[51] Int. Cl.[2] ..... F23G 5/12

[58] Field of Search ..... 110/8 F, 28 J, 8 A; 122/4 D; 432/58

[56] References Cited

UNITED STATES PATENTS

| | | | |
|---|---|---|---|
| 3,515,381 | 6/1970 | Foch | 110/8 |
| 3,702,595 | 11/1972 | Muirhead et al. | 110/28 X |
| 3,772,998 | 11/1973 | Menigat | 110/8 |
| 3,776,150 | 12/1973 | Evans et al. | 110/28 X |
| 3,848,549 | 11/1974 | Pryor et al. | 110/8 |
| 3,863,577 | 2/1975 | Steever et al. | 432/58 X |

*Primary Examiner*—Kenneth W. Sprague
*Attorney, Agent, or Firm*—McGlew and Tuttle

[57] ABSTRACT

A fluidized bed furnace, particularly for burning partly dehydrated sludge, comprises a furnace housing which has a bottom for supporting a fluidized bed and it includes a plurality of nozzles directed to discharge upwardly through the bottom wall into the bed for supplying heating gases including combustion air. The furnace has side walls which extend upwardly from the bottom above the bed and define a combustion chamber above the bed. The combustion chamber is closed at its top by a substantially horizontal furnace roof. At least one sludge charging opening is provided in the furnace roof for charging the sludge downwardly into the combustion chamber. A post combustion chamber is connected downwardly through the roof to the combustion chamber and it is made of a cross-section which is substantially smaller than the combustion chamber. Means are provided for supplying secondary combustion air to the post combustion chamber. Burners are provided for part-time operation which discharge obliquely downwardly into the combustion chamber from the upper portion of the side walls or the furnace roof.

11 Claims, 2 Drawing Figures

FLUIDIZED BED FURNACE FOR BURNING PARTLY DEHYDRATED SLUDGE AND METHOD OF BURNING SLUDGE IN A FLUIDIZED BED FURNACE

FIELD AND BACKGROUND OF THE INVENTION

This invention relates in general to the construction of furnaces and, in particular, to a new and useful fluidized bed furnace for burning partly dehydrated sludge and to a method of burning such sludge in the furnace.

DESCRIPTION OF THE PRIOR ART

The present invention is particularly directed to a fluidized bed furnace for burning partly dehydrated sludge. With such a furnace, the fluidized bed includes a fill of refractory grains and means for supplying air from below for producing the fluidized bed and partly for supplying the necessary combustion air. It is known that particularly sewage sludge can be successfully burned in a fluidized bed furnace in which partly dehydrated sludge is employed so that the burning operation takes place without the necessity of supplying appreciable amounts of heat from the outside. The process is controlled so that the gases which are annoying by their odor are securely burned so that the odor of the resultant discharge is eliminated. This is ensured by maintaining a temperature of from 800° to 900°C in the combustion zone. The ashes which are produced during the combustion of the sludge should not be melted down but they should be carried out by the flue gases to the greatest possible extent in order that the ashes may be subsequently separated from the flue gases. In such arrangements, the sludge to be burned is fed in either from a bin which is located above the fluidized bed furnace through a gravity tube extending centrally through the fluidized bed furnace down to the level of the combustion zone, or they are fed laterally directly into the fluidized bed by means of a feeding screw. With the first manner of feeding, it is assumed that the sludge may be supplied into the furnace from a level which corresponds to the fluidized bed level. However, this is not always possible since, for hydromechanical reasons, the sludge is mostly available at the ground level or even near the water surface level. Therefore, the sludge must first be transported into a bin located above the furnace for which purpose, in view of the nature of the sludge, only a very expensive device, such as a bucket elevator or the like, are suitable for such operation. With the second method of feeding directly into the fluidized bed, the pressure is very irregular so that the performance of the fluidized bed is correspondingly low. Also, in this case, the fluidized bed is intensely cooled down at the feed inlet and this may result in interruptions of the operation.

SUMMARY OF THE INVENTION

The present invention provides a fluidized bed furnace which is designed such that the transportation costs for the sludge are minimized without causing an excessive throughput in the fluidized bed. This advantage, as well as others are obtained in accordance with the invention by providing a furnace roof above the combustion chamber which is substantially horizontal and which is provided with an opening for attaching a post combustion chamber thereabove which has a substantially smaller cross-section than the combustion chamber. A supply connection for secondary combustion air is connected into the post combustion chamber. The furnace roof is also provided with another opening for feeding the sludge downwardly into the combustion zone.

With the inventive arrangement of fluidized bed furnace, it is assumed that the sludge to be burned is transported only to the level of the furnace roof. From this level, the feeding is possible without the use of a gravity tube so that the expense for such a tube and its replacement during the operation are avoided. A particular advantage is that the distribution of the feed in sludge within the combustion chamber is such that the contact with the fluidized bed in which the supply sludge is dried, pulverized and partly burned and subsequently gasified and incinerated is approximately central and relatively uniform. The relatively voluminous combustion chamber of the inventive arrangement ensures an extensive burning out of the combustible gases escaping from the fluidized bed and air is supplied at the bottom to maintain the bed. The post combustion takes place in a relatively small post combustion chamber. Since the flow velocity is higher in the post combustion chamber because it has a substantially smaller cross-section than the main combustion chamber, the preponderant part of the ashes is entrained at such location. This can be advantageously utilized by designing the post combustion chamber as a radiation recuperator because the dust particles permit a great heat transfer by radiation. At the same time, the drop of the flue gas temperature entails an improvement of the conditions for the final dust separation.

In view of the reduction of sludge transportation costs with the invention, it is particularly advantageous to provide sludge treatment devices on the roof of the furnace so that only at this location is the sludge brought into a state more suitable for feeding. Consequently, the sludge can be easily pumped in a still relatively very fluid state to the roof level at which pumping may be easily carried out since the roof level is at a height which is not above the normal pumping height at atmospheric pressure. By appropriate further treatment in centrifuges, filter presses, or the like, the sludge can be dehydrated to the necessary extent and thereby made suitable for feeding directly at the furnace roof.

Since with the invention, the difficulties in the transportation of sludge which is feedable from above are largely eliminated, the post combustion chamber can be designed, as to its length, as a recuperator, so that a large part of the heat produced by the sludge combustion may be recuperated. This is of great importance particularly for sludge combustion because the water content allowable in the sludge to be burned can be higher the more the combustion air supplied into the fluidized bed and the combustion chamber is preheated. Thus, the novel fluidized bed furnace simultaneously provides conditions for an appreciable reduction of the sludge dehydration costs.

By making the cross-section of the combustion chamber substantially larger than the post combustion chamber, in accordance with the invention, and by also designing the chambers so that the combustion chamber has semi-cylindrical ends and intermediate rectangular portions, an optimal design is effected. With the invention, therefore, the usual circular cross-section of the fluidized bed may be abandoned. The central rectangular portion of the combustion chamber may be elongated or made relatively short and the inlet of the post combustion chamber is provided either in the zone of the end half-cylindrical portions or in the center of the rectangle. In the case where the post combustion chamber connects into the center of the central rectangular portion, a feed opening for the sludge may be provided in the zone of each of the two semi-cylindrical portions so that, even with an elongated fluidized bed, a uniform contact is ensured. In a variation of the invention, oval or even triangular cross-sections may be provided for the combustion chamber so that the conditions for a regular operation of the fluidized bed can be obtained also in larger furnace units.

Accordingly, it is an object of the invention to provide a fluidized bed furnace, particularly for burning partly dehydrated sludge, which includes a furnace housing which has a bottom for supporting a fluidized bed with means for directing heated gases, including combustion air, upwardly through the bed, and which includes side walls extending upwardly from the bottom above the bed and defining a combustion chamber above the bed with a substantially horizontal roof extending over the combustion chamber, and having at least one sludge charging opening therein for charging the sludge downwardly into the combustion chamber and a connection for a post combustion chamber which extends upwardly from the main combustion chamber and it is substantially smaller in cross-section than the main combustion chamber and which is provided with means for supplying secondary air thereto.

A further object of the invention is to provide a method of operating a fluidized bed furnace which comprises a bottom over which a fluidized bed is formed and a post combustion chamber connected into a main combustion chamber above the fluid bed, comprising directing heating gases, including combustion air, upwardly through the bottom to maintain a fluidized bed above the bottom and to maintain a combustion of gases above the fluidized bed, directing the gases which are formed through a relatively small diameter post combustion chamber, continuously maintaining post combustion in the post combustion chamber by adding additional combustion air thereto and charging the furnace with sludge from the roof thereof downwardly into the combustion chamber.

A further object of the invention is to provide a fluidized bed furnace which is simple in design, rugged in construction, and economical to manufacture.

For an understanding of the principles of the invention, reference is made to the following description of typical embodiments thereof as illustrated in the accompanying drawing.

DESCRIPTION OF THE PREFERRED EMBODIMENTS

Figure 1:
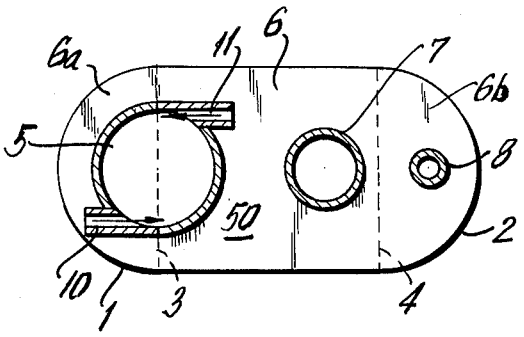
FIG. 1 is a horizontal sectional view of a dehydrated sludge furnace constructed in accordance with the invention.

Referring to the drawing in particular, the invention embodied therein in FIG. 1 comprises a fluid bed furnace which, as shown in plan view, includes two semicircular end walls 1 and 2 which join respective ends of an intermediate rectangular portion 6. The termination of the ends of the rectangular central section 6 is indicated by dotted lines 3 and 4. In this construction of furnace, in accordance with the invention, there is provided a post combustion chamber 5 which connects downwardly into the top or roof 50 of the combustion chamber which is located below the roof 50. The combustion chamber has the area of the entire roof 50, including the central rectangular section 6 and the two end cylindrical sections 6*a* and 6*b*. Air supply conduits 10 and 11 are connected tangentially into the post combustion chamber 5 for supplying sufficient after combustion air thereto. The sludge is advantageously charged through the roof 50 through an opening 7 provided for that purpose. A further opening 8 is provided for a burner which is directed downwardly through the roof 50 into the combustion chamber.

Figure 2:
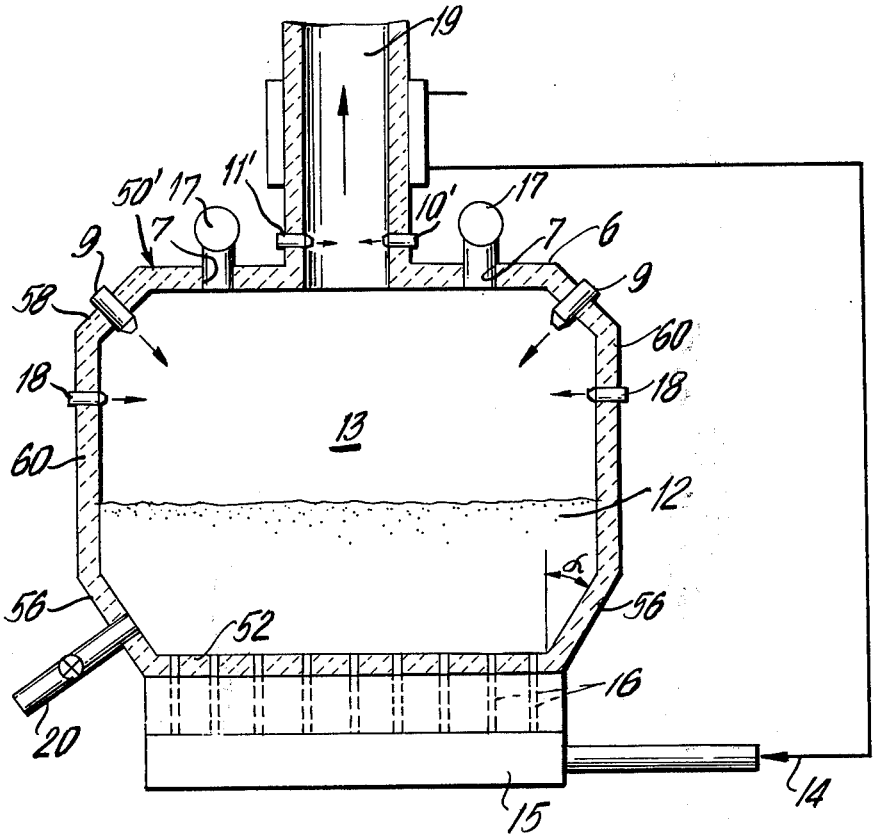
FIG. 2 is a vertical sectional view of another embodiment of sludge furnace constructed in accordance with the invention.

In the embodiment of the invention shown in FIG. 2, the fluidized bed furnace shown in vertical cross-section includes a bottom wall 52 over which a fluidized bed 12 is maintained. The fluidized bed includes refractory particles and it is maintained in a fluidized condition by directing heating gases upwardly through the bottom 52 through an inlet connection 54 leading to a plurality of upwardly directed nozzles 16. The heating gases are directed in the direction of the arrow 14 through the connection 54 and the nozzle 16 and they provide combustion air for the maintenance of combustion in the fluidized bed 12. In a preferred form, guide walls 56 immediately adjacent the bottom 52 flare upwardly and outwardly in order to increase the area of the fluidized bed immediately above the bottom 52.

In addition to the combustion which is maintained by the heated gases directed through the conduit 54, it is sometimes also necessary, usually periodically, to direct a combustible fuel into the furnace by means of burners 9 which are oriented at oblique sections 58 adjacent the top of the furnace side walls 60. Immediately above the fluidized bed 12, the furnace defines a combustion chamber 13 which is covered at the top by a substantially horizontal roof 50′.

After the gases are burned in the combustion space 13, they are passed upwardly through a post combustion chamber 19 which is of much smaller diameter or cross-section than the main combustion chamber 13. Advantageously, combustion air, which may be supplied through the conduit 14, is first passed into association with the post combustion chamber 19 which is designed as a recuperator, so that the air is preheated, before it is passed through the fluidized bed 12.

In accordance with a further feature of the invention, openings 7 are provided in furnace roof 50 for the direct feeding of the sludge which has been previously dehydrated. In the preferred form, the sludge is dehydrated preferably by centrifuge means 17 which are located directly above the openings 7.

The gases produced during the burning of the sludge in fluidized bed 12 burn out in the combustion chamber under supply of combustion air introduced laterally into the combustion chamber through nozzles 18 located on each side wall 60. Advantageously, this combustion air is also preheated in the recuperator so that a temperature of 800° to 900°C is maintained in combustion chamber 13. Should it not be possible to obtain this temperature by the sludge combustion, the heating burners 9 are put into operation by means of control means (not shown) until the conditions for the maintenance of the temperature of the sludge combustion are re-established. The combustion gases which leave the combustion chamber 13 and pass into the post combustion chamber are not completely burned. For this reason, secondary air is directed tangentially into the post combustion chamber 19 through two diametrically oppositely arranged inlet nozzles 10' and 11'. The post combustion chamber 19 is designed as a recuperator so that it is possible to simultaneously recuperate heat for heating up the combustion air. Preferably, the device comprises a radiation recuperator so as to permit the heat transfer by radiation of the dust containing flue gases.

The furnace includes an outlet connection 20 so that useless material may be discharged from the lower end of the bed 12.

The combustion chamber is advantageously provided with the oblique walls 58 at each side so that the burners 9 may be directed downwardly into the combustion chamber 13 and be in an orientation such that they will not be subject to the accumulation of dust and debris thereon and will be free from a risk of clogging. This is very important since the burners are not permanently in operation and frequently, they will be out of service for long periods. In addition to the fact that the oblique arrangement prevents the clogging of the burners, the position also ensures that the spacing between the burner walls and the refractory brickwork will not become clogged either due to their inclined disposition.

In order to ensure a satisfactory motion of the fluidized bed 12, particularly in the marginal zones at each end, the side walls 60 are enlarged outwardly and upwardly, preferably, by an angle $\alpha$ of from 15° to 20° relative to the vertical. The construction ensures that the entire surface of the fluidized bed can be kept in motion.

The post-combustion chamber advantageously has either a circular cross-section or an angular cross-section. an angular cross-section would be advantageous for the support of the post combustion chamber on the furnace roof because a formation of the post combustion chamber with two rectangular sides, for example, arranged opposite to each other, can be mounted directly on the upper edges of the longitudinal walls of the furnace roof 50', while the other two rectangular sides can project from the substantially plane furnace roof 50' vertically upwardly. In some instances, the furnace is constructed as a waste heat boiler, and in such instances, it is desirable to have the furnace of substantially rectangular cross-section. Post combustion chamber recuperator 19 would also advantageously be of rectangular cross-section which would continuously change with increasing height into a circular cross-section.

While specific embodiments of the invention have been shown and described in detail to illustrate the application of the principles of the invention, it will be understood that the invention may be embodied otherwise without departing from such principles.

What is claimed is:

1. A fluidized bed furnace, particularly for burning partly dehydrated sludge, comprising a furnace housing having a bottom for supporting a fluidized bed, means for directing heated gases including combustion air upwardly from said bottom into the fluidized bed for maintaining said bed, said furnace having side walls extending upwardly from said bottom above said bed and defining a combustion chamber above said bed, a substantially horizontal furnace roof extending between said side walls defining a top of said combustion chamber and having at least one sludge charging opening therein for charging the sludge downwardly into said combustion chamber and also having a post combustion chamber opening, post combustion chamber wall means defining a post combustion chamber extending upwardly from said post combustion chamber opening and being substantially smaller in cross-section than the cross-section of said combustion chamber, and means for supplying secondary air into said post combustion chamber.

2. A fluidized bed furnace, according to claim 1, including a conduit connected to said sludge charging opening having a sludge treatment device.

3. A fluidized bed furnace, according to claim 1, wherein said combustion chamber is of a cross section which includes a central rectangular portion with an end portion on each side of the rectangular portion of a semi-circular configuration, said post combustion chamber opening being located adjacent at least one of the semi-circular portions.

4. A fluidized bed furnace, according to claim 1, wherein the combustion chamber has a cross-section which includes a central elongated rectangular portion with a semi-circular portion at each end, said post combustion chamber being located centrally of said rectangular portion, said sludge opening being located adjacent an end semi-circular portion.

5. A fluidized bed furnace, according to claim 1, wherein said side walls enlarge upwardly from said bottom at an angle of from 15° to 20° relative to the vertical.

6. A fluidized bed furnace, according to claim 1, wherein the upper portion of said side walls extends obliquely inwardly to said furnace roof, and a burner in each obliquely extending portion extending downwardly toward said combustion chamber.

7. A fluidized bed furnace, according to claim 1, wherein said post combustion chamber comprises a radiation recuperator for heating the combustion air directed through the fluidized bed.

8. A fluidized bed furnace, according to claim 1, wherein said means for supplying said secondary combustion air comprises a conduit connected tangentially into said post combustion chamber.

9. A fluidized bed furnace, according to claim 1, wherein said post combustion chamber is of rectangular configuration.

10. A fluidized bed furnace, according to claim 1, wherein said post combustion chamber includes two rectangular side portions opposite to each other which are mounted on said furnace roof.

11. A fluidized bed furnace according to claim 1, wherein the interior of said furnace has a width at least as great as the height.

* * * * *